US010236626B2

(12) United States Patent
Panitz

(10) Patent No.: US 10,236,626 B2
(45) Date of Patent: Mar. 19, 2019

(54) PLUG INSERT WITH POSITIONING ELEMENT

(71) Applicant: TE Connectivity Germany GmbH, Bensheim (DE)

(72) Inventor: Gregor Panitz, Sorgenloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/653,987

(22) Filed: Jul. 19, 2017

(65) Prior Publication Data

US 2018/0026392 A1 Jan. 25, 2018

(30) Foreign Application Priority Data

Jul. 20, 2016 (DE) ..... 10 2016 213 291

(51) Int. Cl.

| | |
|---|---|
| ***H01R 13/42*** | (2006.01) |
| ***H01R 13/44*** | (2006.01) |
| ***H01R 13/62*** | (2006.01) |
| ***H01R 24/50*** | (2011.01) |
| ***H01R 24/56*** | (2011.01) |
| ***H01R 31/06*** | (2006.01) |
| ***H01R 13/502*** | (2006.01) |
| ***H01R 13/631*** | (2006.01) |
| ***H01R 13/6593*** | (2011.01) |

(52) U.S. Cl.

CPC ..... *H01R 13/62* (2013.01); *H01R 13/42* (2013.01); *H01R 13/44* (2013.01); *H01R 13/502* (2013.01); *H01R 13/6315* (2013.01); *H01R 24/50* (2013.01); *H01R 24/56* (2013.01); *H01R 31/06* (2013.01); *H01R 13/6593* (2013.01)

(58) Field of Classification Search

CPC ..... H01R 13/6315; H01R 13/4223; H01R 13/113; H01R 13/4226; H01R 12/57; H01R 13/187; H01R 13/62; H01R 13/42; H01R 13/44; H01R 13/502; H01R 13/6593; H01R 24/56; H01R 24/50; H01R 31/06

USPC ..... 439/246, 252, 752.5

See application file for complete search history.

(56) References Cited

U.S. PATENT DOCUMENTS 3,091,748 A * 5/1963 Takes ..... H01R 13/631 439/246
4,697,859 A * 10/1987 Fisher, Jr. ..... H01R 13/6315 439/246
5,425,661 A * 6/1995 Self, Jr. ..... H01R 13/432 439/748

(Continued)

FOREIGN PATENT DOCUMENTS

DE 3833196 A1 4/1990

OTHER PUBLICATIONS

German Office Action, dated Mar. 31, 2017, 6 pages.

*Primary Examiner* — Gary F Paumen
(74) *Attorney, Agent, or Firm* — Barley Snyder

(57) ABSTRACT

A plug insert comprises a base body, a receptacle extending through the base body, and a positioning element at least partially received in the receptacle. The base body has a plug side and an opposite contact side. The receptacle extends through the base body from the plug side to the contact side and at least partially receives a connector. The positioning element is accessible from both the plug side and the contact side and positions a contact pin of the connector.

27 Claims, 7 Drawing Sheets

(56) References Cited

U.S. PATENT DOCUMENTS

| | | | | |
|---|---|---|---|---|
| 7,607,929 | B1 * | 10/2009 | Nguyen | H01R 13/6315 439/246 |
| 8,029,324 | B1 * | 10/2011 | Yi | H01R 13/518 439/745 |
| 8,740,629 | B1 * | 6/2014 | Hall | H01R 13/6456 439/63 |
| 2016/0072213 | A1 | 3/2016 | Ichio et al. | |

* cited by examiner

PLUG INSERT WITH POSITIONING ELEMENT

CROSS-REFERENCE TO RELATED APPLICATION

This application claims the benefit of the filing date under 35 U.S.C. § 119(a)-(d) of German Patent Application No. 102016213291.1, filed on Jul. 20, 2016.

FIELD OF THE INVENTION

The present invention relates to a plug insert and, more particularly, to a plug insert receiving an electrical contact.

BACKGROUND

In the automotive industry, connectors such as FAKRA (specialized automotive) connectors or HSD (high speed data) connectors are used to tap off or feed high-frequency and/or interference-prone signals of a vehicle bus. The connectors are combined in a bus adapter. As is known in the art, this combination takes place in a plug insert, which provides a plug face with the connectors; peripheral devices having a plug connection are connected to the vehicle bus by the plug insert. The connectors are provided with a shielding which accommodates different connectors or some of the connectors in the plug insert. At the vehicle side, the plug insert is electrically connected to a circuit board. Narrow positioning tolerances are required in order to enable surface mounting on the circuit board and soldering, press-fitting, or similar joining processes.

A plug insert 1' known in the prior art is shown in FIGS. 1 and 2. The plug insert 1', as shown in FIG. 1, has a plug side 3 and a contact side 5. The plug insert 1' has eight receptacles 7, each receptacle 7 receiving a connector 9. FIG. 1 shows that different kinds of connectors 9 may be received in the plug insert 1'. The embodiment of FIG. 1 shows seven connectors 9 designed as FAKRA connectors 9*a* and one connector 9 designed as a HSD connector 9*b*. All connectors 9 have an electromagnetic shielding 11 and at least one contact pin 13 received in the electromagnetic shielding 11. As shown in FIG. 2, the receptacles 7 have seven FAKRA receptacles 7*a* and one HSD receptacle 7*b*, the HSD receptacle 7*b* differs from the FAKRA receptacle 7*a* merely in having a different diameter d. The receptacles 7 of the plug insert 1' extend continuously from the contact side 5 to the plug side 3. The connectors 9 are inserted from the contact side 5 into the respective receptacles 7; the contact pins 13 are positioned by the plug insert 1' only indirectly via the electromagnetic shielding 11.

In the solutions of the prior art, and owing to a nested design of the aforementioned connectors (FAKRA/HSD), it is sometimes not possible or very difficult to maintain the positioning tolerances of the contacts. There is a need for a plug insert, having several shielded connectors or shielded with unshielded connectors, which can maintain narrow positioning tolerances of soldering pins of the connectors to be soldered or press-fit pins of the connectors to be press-fit.

SUMMARY

A plug insert according to the invention comprises a base body, a receptacle extending through the base body, and a positioning element at least partially received in the receptacle. The base body has a plug side and an opposite contact side. The receptacle extends through the base body from the plug side to the contact side and at least partially receives a connector. The positioning element is accessible from both the plug side and the contact side and positions a contact pin of the connector.

BRIEF DESCRIPTION OF THE DRAWINGS

The invention will now be described by way of example with reference to the accompanying FIGS., of which.

DETAILED DESCRIPTION OF THE EMBODIMENT(S)

Figure 1:
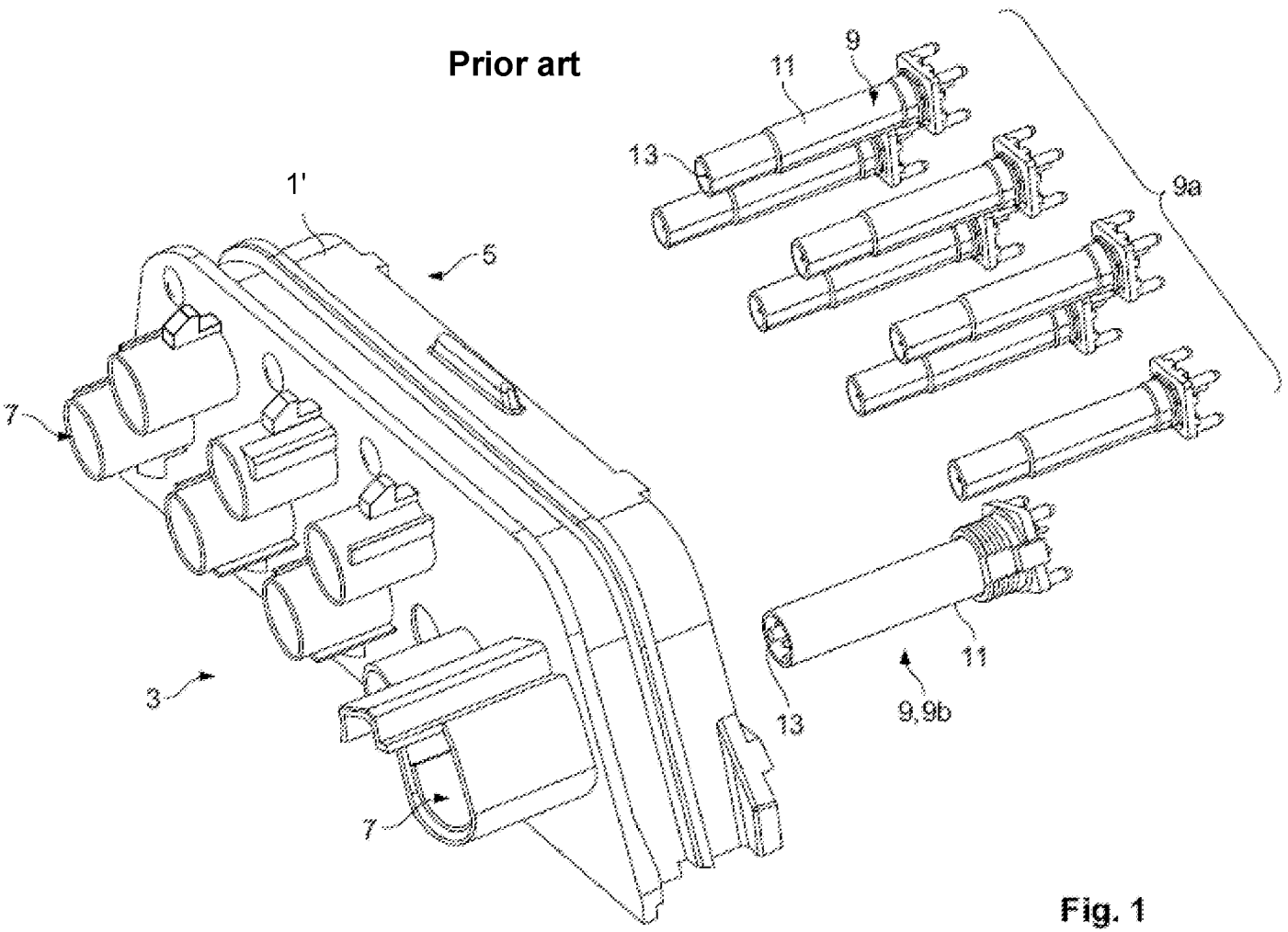
FIG. 1 is a perspective view of a plug insert according to the prior art.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
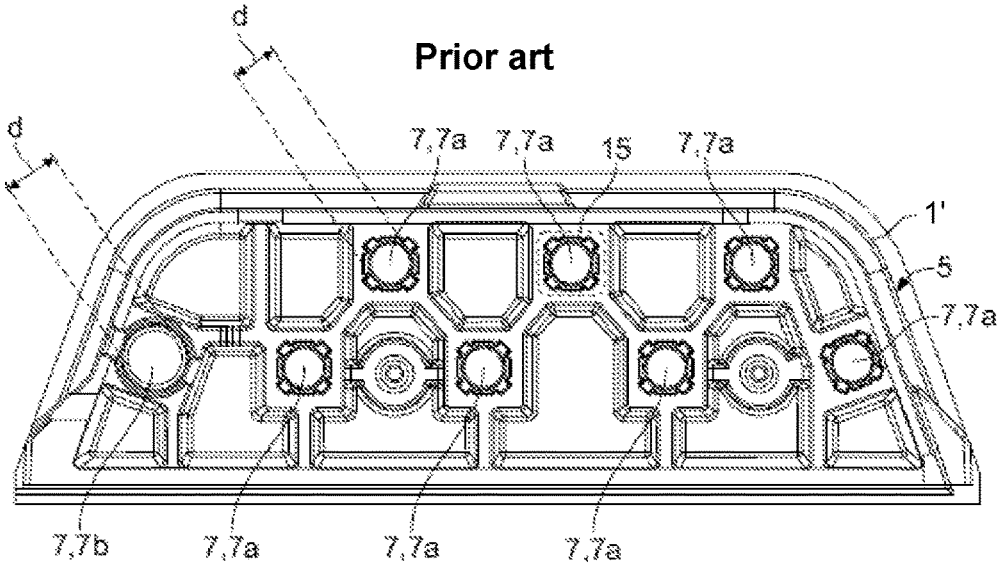
FIG. 2 is a rear view of the prior art plug insert of FIG. 1.
Figure 3A:
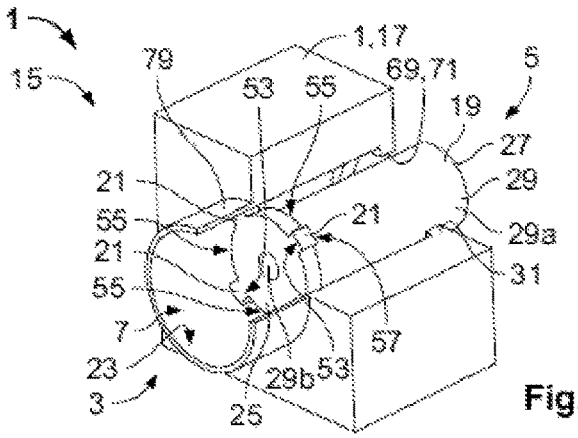
FIG. 3A is a detail perspective view of a plug insert according to a first embodiment of the invention.
Figure 3B:
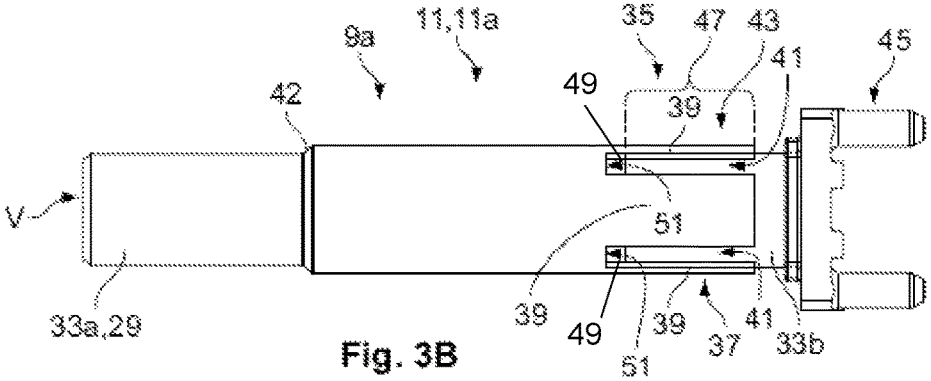
FIG. 3B is a side view of a modular electromagnetic shielding of the plug insert of FIG. 3A.

A plug insert 1 according to the invention is shown in FIGS. 3A and 3B. FIG. 3A shows a detail 15 of the plug insert 1, the detail 15 is shown as a dashed line in FIG. 2 for reference with respect to the plug insert 1' of the prior art. The plug insert 1 has a base body 17, a receptacle 7 extending through the base body 17, and a positioning element 19 received in the receptacle 7.

The positioning element 19, as shown in FIG. 3A, is joined by four connecting webs 21 to an inner wall 23 of the receptacle 7. The connecting webs 21 may be monolithically formed with the inner wall 23 or may be formed separately and connected to the inner wall 23. The connecting webs 21 are arranged in the first embodiment shown in FIG. 3 at an end of the positioning element 19 facing a plug side 3, that is, a plug-side end 25 of the positioning element 19. An opposite contact-side end 27 of the positioning element 19 protrudes from the receptacle 7 beyond the base body 17 of the plug insert 1 toward the contact side 5. A longitudinal direction of the positing element 19 extends from the plug-side end 25 to the contact-side end 27. At the contact-side end 27, the positioning element 19 is not joined to the base body 17 of the plug insert 1. The positioning element 19 is a hollow cylinder 29 and has a lateral surface 29*a* and a center opening 29*b*. The center opening 29*b* is continuous from the plug-side end 25 to the contact-side end 27 and may be formed centrally on the positioning element 19 or may be offset from a center of the positioning element 19.

The plug insert 1, as shown in FIG. 3A, has a monolithically formed edge 31 disposed at the contact side 5 and extending circumferentially around the inner wall 23 of the receptacle 7. The plug insert 1 has a supporting collar 79 protruding from the plug side 3.

An electromagnetic shielding 11 designed as a modular electromagnetic shielding 11*a* is shown in FIG. 3B. The modular electromagnetic shielding 11*a* has two shielding elements 33, where one plug-side shielding element 33*a* is configured substantially as a hollow cylinder 29 and a contact-side shielding element 33*b* is at least partially received in the plug-side shielding element 33*a*. The modular electromagnetic shielding 11*a* is shown in an installed state 35 in FIG. 3B; the relative position of the plug-side shielding element 33*a* to the contact-side shielding element 33*b* is representative of the relative position of the two elements 33*a*, 33*b* to each other when they are received in the receptacle 7 shown in FIG. 3A.

As shown in FIG. 3B, the plug-side shielding element 33*a* has a toothing 37, which comprises four teeth 39 and four recesses 41 in the embodiment shown. In the shown embodiment, the plug-side shielding element 33*a* has a tapering 42 used for a FAKRA connector 9*a*. The contact-side shielding element 33*b* comprises a shielding area 43 and a base area 45.

The two shielding elements 33*a*, 33*b* form an overlap area 47. The embodiment of the modular electromagnetic shielding 11*a* shown in FIG. 3B has four free sites 49 on a side of the overlap area 47 where no shielding of the volume V enclosed by the shielding elements 33*a*, 33*b* is present.

The position of the modular electromagnetic shielding 11*a* shown in FIG. 3B in an installed state 35 in the plug insert 1 shown in FIG. 3A will now be described.

The plug-side shielding element 33*a* is inserted from the plug side 3 into the receptacle 7 of the plug insert 1. The four connecting webs 21 are received in the four recesses 41 of the plug-side shielding element 33*a*. The plug-side shielding element 33*a* is received far enough in the receptacle 7 so that a recess abutment surface 51 present in each recess 41 lies against a plug-side abutment surface 53 present on one of the connecting webs 21. The teeth 39 of the plug-side shielding element 33*a* are received in apertures 55 formed between the connecting webs 21. The plug-side shielding element 33*a* is received and supported at least for a portion in the supporting collar 79. The supporting collar 79 is form-fitted to the plug-side shielding element 33*a*

The shielding area 43 of the contact-side shielding element 33*b* is inserted from the contact side 5 into the receptacle 7, the shielding area 43 receiving the positioning element 19 at least partly, starting with the contact-side end 27. The shielding area 43 is moved through the hollow cylinder 29 of the positioning element 19 until it abuts a contact-side abutment surface 57 of the connecting web 21. The contact-side abutment surfaces 57 of the connecting webs 21 are opposite the plug-side abutment surfaces 53 and point toward the contact side 5. In the installed state 35 shown in FIG. 3B, the connecting webs 21 extend through the free sites 49.

Figure 4A:
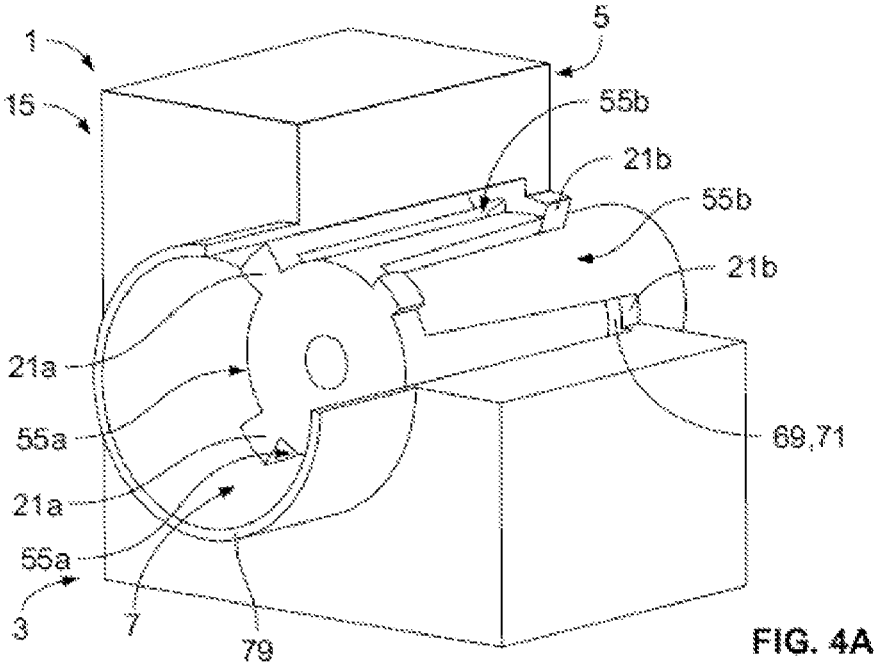
FIG. 4A is a detail perspective view of a plug insert according to a second embodiment of the invention.
Figure 4B:
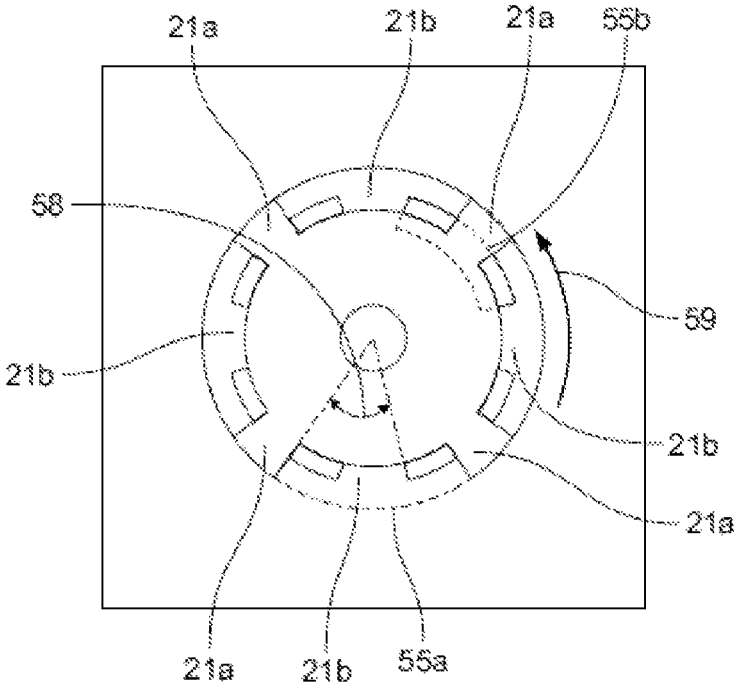
FIG. 4B is a front view of the plug insert of FIG. 4A.

A plug insert 1 according to a second embodiment of the invention is shown in FIGS. 4A and 4B. FIGS. 4A and 4B show a same detail 15 as the embodiment of FIGS. 3A and 3B.

Unlike the first embodiment of FIGS. 3A and 3B, the plug insert 1 shown in FIGS. 4A and 4B has four plug-side connecting webs 21*a* and four contact-side connecting webs 21*b*.

The plug-side connecting webs 21*a* form plug-side apertures 55*a*, and the contact-side connecting webs 21*b* form contact-side apertures 55*b*. As shown in FIG. 4B, in a longitudinal direction of the receptacle 7, the plug-side connecting webs 21*a* overlap the contact-side apertures 55*b* and the contact-side connecting webs 21*b* overlap the plug-side apertures 55*a*. The plug-side connecting webs 21*a* are offset 58 from the contact side connecting webs 41*b* in a circumferential direction 59.

Figure 5:
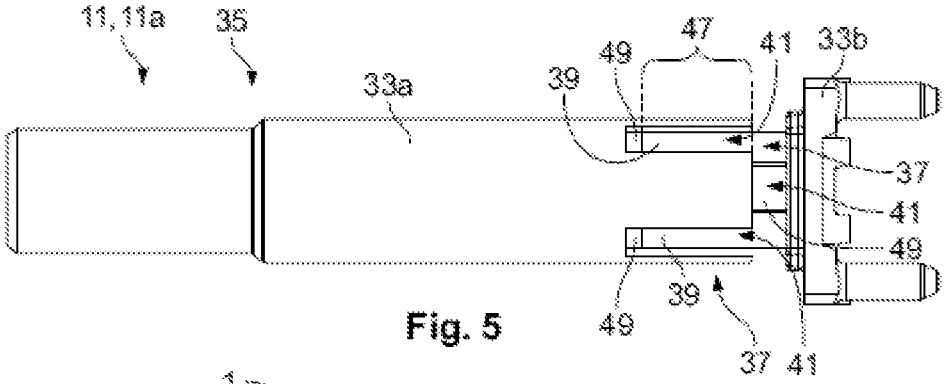
FIG. 5 is a side view of a modular electromagnetic shielding of the plug insert of FIG. 4A.

The modular electromagnetic shielding 11*a* of the second embodiment, as shown in FIG. 5, has a plug-side shielding element 33*a* and a contact-side shielding element 33*b*. The plug-side shielding element 33*a* of the second embodiment is substantially identical to that of the first embodiment shown in FIG. 3B. The contact-side shielding element 33*b* of the second embodiment shown in FIG. 5, by contrast to that of the first embodiment shown in FIG. 3B, has recesses 41 and a toothing 37 similar to those of the plug-side shielding element 33*a*. Bordering on the overlap area 47, free sites 49 are formed on both sides of the overlap area 47 in the installed state 35, so that in total eight free sites 49 of the electromagnetic shielding 11 are formed in the second embodiment shown in FIG. 5.

The receiving of the plug-side shielding element 33*a* in the receptacle 7 of the plug insert 1 occurs analogously to the inserting of the plug-side shielding element 33*a* shown in FIG. 3 and described above. The contact-side shielding element 33*b* of the second embodiment shown in FIG. 5 is introduced into the receptacle 7 from the contact side 5 so that the teeth 39 are introduced into the contact-side apertures 55*b* and the contact-side connecting webs 21*b* are received in the recesses 41 of the contact-side shielding element 33*b*. In the installed state 35 shown in FIG. 5, the connecting webs 21*a*, 21*b* extend through the free sites 49. Both the plug-side shielding element 33*a* and the contact-side shielding element 33*b* abut both the plug-side connecting webs 21*a* and the contact-side connecting webs 21*b*.

Figure 6A:
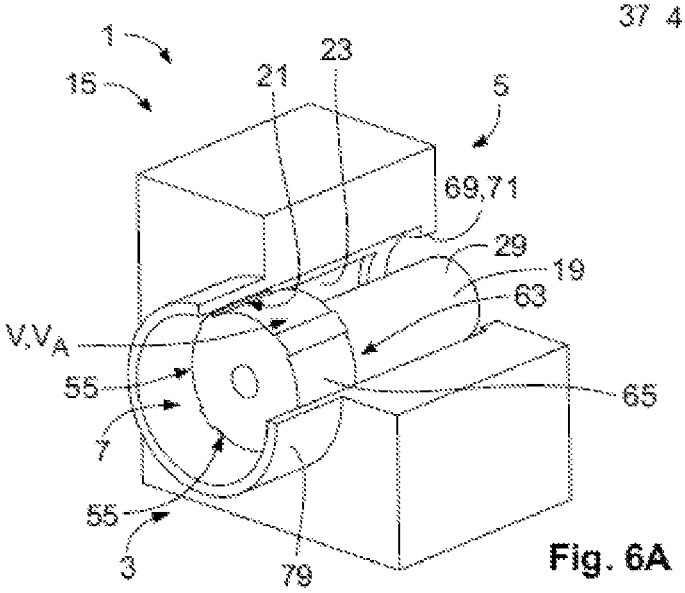
FIG. 6A is a detail front perspective view of a plug insert according to a third embodiment of the invention.
Figure 6B:
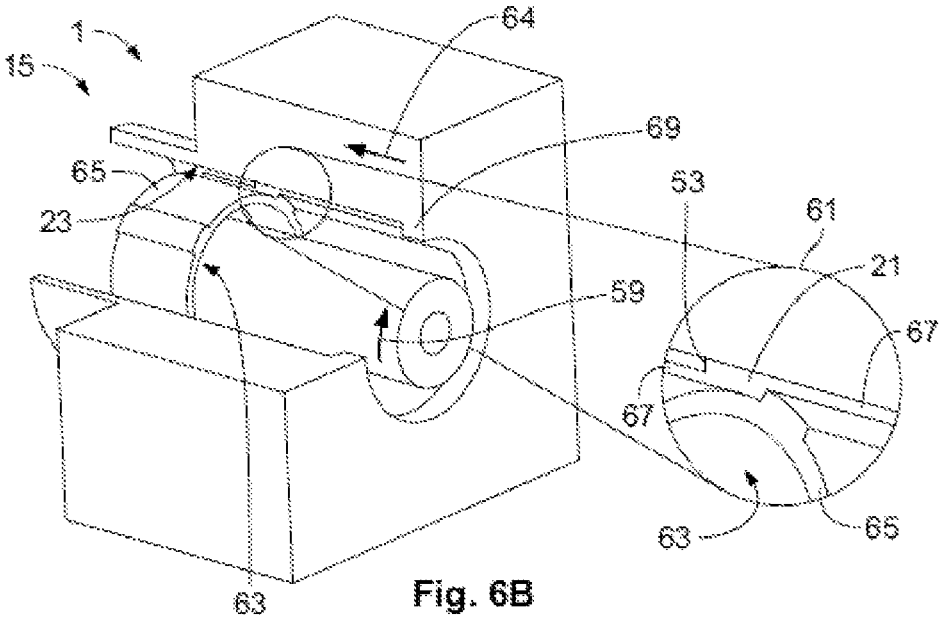
FIG. 6B is a detail rear perspective view of the plug insert of FIG. 6A.

A plug insert 1 according to a third embodiment of the invention is shown in FIGS. 6A and 6B. FIGS. 6A and 6B show a same detail 15 as the embodiment of FIGS. 3A and 3B.

Figure 7A:
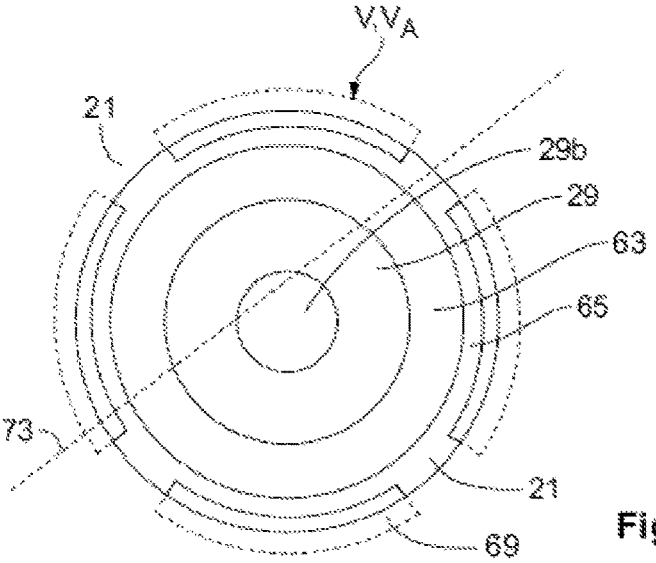
FIG. 7A is a rear view of the plug insert of FIG. 6A.

The plug insert 1 of the third embodiment, as shown in FIGS. 6A, 6B, and 7A has four connecting webs 21. The positioning element 19 of the third embodiment has a receiving pocket 63, which is formed between the hollow cylinder 29 and a collar wall 65 and which extends in the circumferential direction 59 in a direction of extension 64 or a longitudinal direction of the positioning element 19. The cross section of the pocket 63 is substantially U-shaped.

The connecting webs 21 of the third embodiment shown in FIGS. 6A, 6B, and 7A extend at the plug side 3 into longitudinal struts 67 formed on the collar wall 65 and at the contact side 5 into longitudinal struts 67 formed on the inner wall 23 of the receptacle 7. The longitudinal struts 67 formed on the inner wall 23 extend into a circumferential collar 69 corresponding to the edge 31. A volume V which is bounded by the connecting webs 21, the longitudinal struts 67, and the collar 69 is a receiving volume VA. The collar 69 serves as a limit 71 for receiving the plug-side shielding element 33*a*, the toothing 37 of which abuts against the inner wall of the collar 69 facing the plug side 3.

Figure 7B:
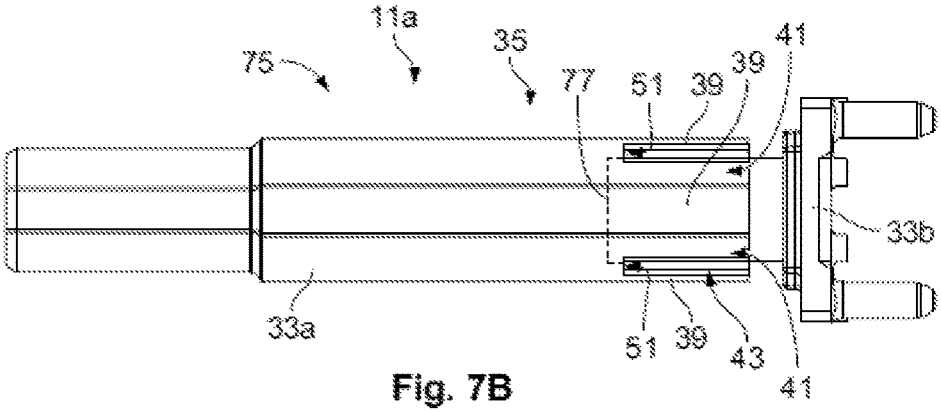
FIG. 7B is a side view of a modular electromagnetic shielding of the plug insert of FIG. 6A.

The modular electromagnetic shielding 11*a* of the third embodiment is shown in the installed state 35 in FIG. 7B. In the third embodiment, the modular electromagnetic shielding 11*a* provides a complete shielding 75 with no free sites 49. As in the first and second embodiment, the plug-side shielding element 33*a* of the third embodiment is received in the receptacle 7 such that the teeth 39 are introduced into the apertures 55 and received in the receiving volume VA and at the same time the connecting webs 21 are introduced into the recesses 41. In the installed state 35, the plug-side abutment surfaces 53 of the connecting webs 21 abut the recess abutment surface 51 of the plug-side shielding element 33*a*. The shielding area 43 of the contact-side shielding element 33*b* of the third embodiment is received in the receiving pocket 63, wherein one end 77 of the contact-side shielding element 33*b* in the installed state 35 extends beyond the recess abutment surface 51 of the plug-side shielding element 33*a* in the direction of the plug side 3.

Figure 8:
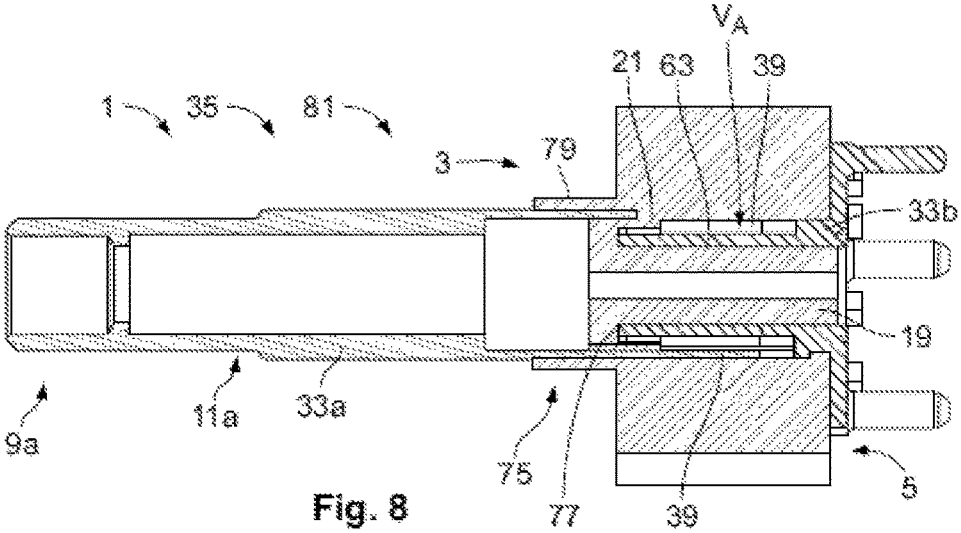
FIG. 8 is a sectional view of the plug insert of FIG. 6A with the modular electromagnetic shielding of FIG. 7B in an installed state.

The plug insert 1 according to the third embodiment is shown with the modular electromagnetic shielding 11*a* received in the installed state 35 in the cross-section 81 of FIG. 8. The cross-section 81 of FIG. 8 is taken along the sectioning line 73 of FIG. 7. The end 77 of the contact-side shielding element 33*b* is received entirely in the receiving pocket 63 and the connecting webs 21 protrude in the direction of the plug side 3. The teeth 39 of the plug-side shielding element 33*a* are received in the receiving volume VA bypassing the connecting webs 21 in the direction of the contact side 5.

In another embodiment, the receiving pocket 63 is formed between the inner wall 23 of the receptacle 7 and the positioning element 19; in this embodiment the longitudinal strut 67 formed on the collar wall 65 extends in the entire circumferential direction 59.

Figure 9A:
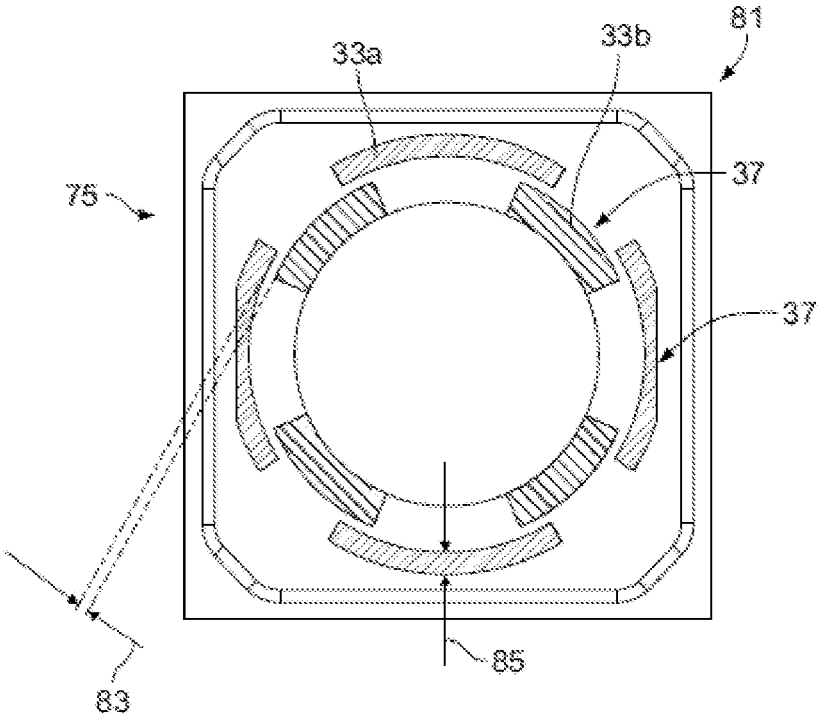
FIG. 9A is a sectional view of the modular electromagnetic shielding of FIG. 7B.
Figure 9B:
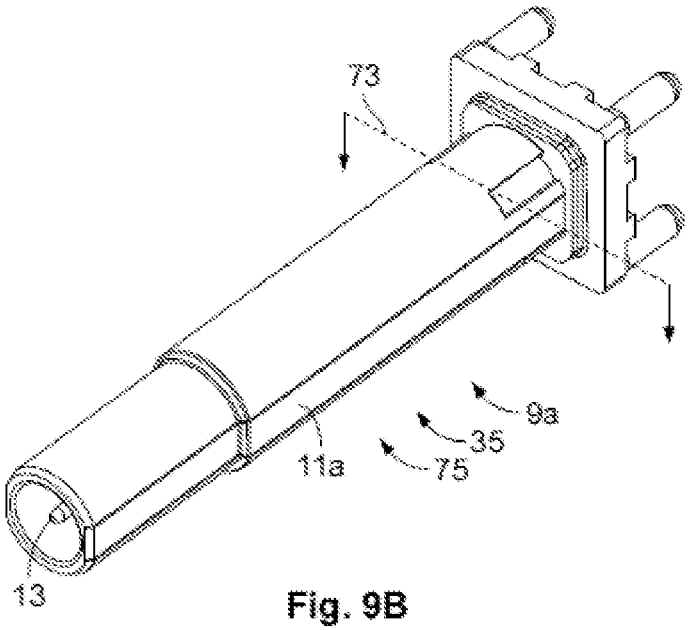
FIG. 9B is a perspective view of the modular electromagnetic shielding of FIG. 7B with a contact.

A FAKRA connector 9*a* is shown in the installed state 35 in FIGS. 9A and 9B with the complete shielding 75 of the third embodiment of the modular electromagnetic shielding 11*a*. The shielded FAKRA connector 9*a* has a contact pin 13 received offset inwardly in the modular electromagnetic shielding 11*a*. As shown in FIG. 9A, a spacing 83 exists between the teeth 39 of the plug-side shielding element 33*a* and the contact-side shielding element 33*b*, which is less than a material thickness 85 of each of the shielding elements 33*a*, 33*b*. This ensures the complete shielding 75.

Figure 10:
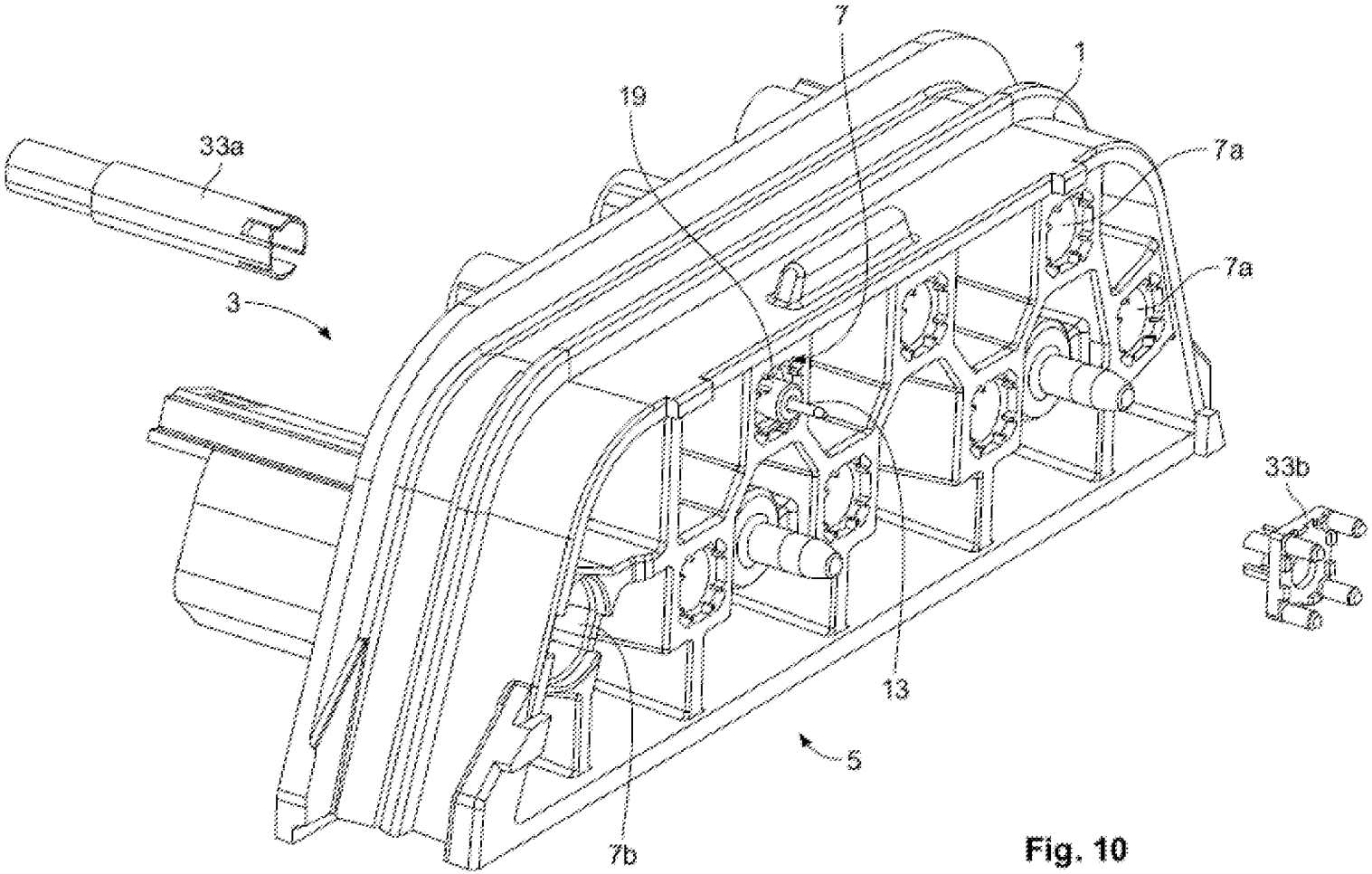
FIG. 10 is a perspective view of the plug insert of FIG. 6A with the modular electromagnetic shielding of FIG. 7B and the contact.

The plug insert 1 of the third embodiment with the contact pin 13 received in the positioning element 19 is shown in FIG. 10. The contact pin 13 is inserted in the center opening 29*b* of the position element 19 and may be inserted from either the plug side 3 or the contact side 5. The positioning element 19 guides the contact pin 13 and fixes the contact pin 13 with respect to the plug insert 1. As described above, the plug-side shielding element 33*a* is inserted into the receptacle 7 from the plug side 3. The contact-side shielding element 33*b* is likewise inserted into the receptacle 7 from the contact side 5, so that in the installed state 35, shown in FIG. 9B, the desired complete shielding 75 of the contact pin 13 is achieved.

The plug insert 1 shown in FIG. 10 has seven FAKRA receptacles 7*a* and one HSD receptacle 7*b*. The geometry and size of the plug insert 1 depends on the number of combined connectors, their arrangement, and the geometry of the plug in which the individual different connectors are to be combined. A plug insert 1 according to the invention may thus have any given number of receptacles 7 of different size and shape and thus combine any given number of different or identical connectors in one plug insert 1.

What is claimed is:

1. A plug insert, comprising:

a base body having a plug side and an opposite contact side;

a receptacle extending through the base body from the plug side to the contact side and at least partially receiving a connector, the connector including an electromagnetic shielding having at least two shielding elements including a plug-side shielding element inserted from the plug side into the receptacle and a contact-side shielding element inserted from the contact side into the receptacle to form the electromagnetic shielding; and a positioning element at least partially received in the receptacle and accessible from both the plug side and the contact side, the positioning element positioning a contact pin of the connector and having a connecting web connecting the positioning element to the receptacle.

2. The plug insert of claim 1, wherein the positioning element has a center opening extending continuously through the positioning element from the plug side to the contact side.

3. The plug insert of claim 2, wherein the center opening receives the contact pin.

4. The plug insert of claim 1, wherein at least two connecting webs connect the positioning element to the receptacle and hold the positioning element symmetrically in the receptacle.

5. The plug insert of claim 4, wherein an aperture is disposed in a circumferential direction about the positioning element and between the at least two connecting webs.

6. The plug insert of claim 5, wherein the aperture extends continuously along the positioning element from the plug side to the contact side.

7. The plug insert of claim 4, wherein the at least two connecting webs include at least one plug-side connecting web and at least one contact-side connecting web, the at least one plug-side connecting web and the at least one contact-side connecting web offset relative to each other in the circumferential direction.

8. The plug insert of claim 7, wherein the at least one plug-side connecting web and the at least one contact-side connecting web are offset relative to each other in a longitudinal direction of the positioning element extending between the plug side and the contact side.

9. The plug insert of claim 1, wherein the positioning element has a receiving pocket disposed in the receptacle and receiving one of the at least two shielding elements.

10. The plug insert of claim 9, wherein the receiving pocket overlaps the connecting web in a longitudinal direction of the positioning element.

11. The plug insert of claim 1, wherein a portion of each of the plug-side shielding element and the contact-side shielding element is disposed between the positioning element and an inner wall of the receptacle.

12. The plug insert of claim 11, wherein an end of the contact-side shielding element overlaps an end of the plug-side shielding element in the receptacle.

13. The plug insert of claim 12, wherein the plug-side shielding element has a recess at the end, the recess extending in a circumferential direction to form a toothing of the plug-side shielding element.

14. The plug insert of claim 13, wherein the toothing of the plug-side shielding element is complementary to a toothing of the contact-side shielding element disposed at the end of the contact-side shielding element.

15. The plug insert of claim 14, the toothing of the plug-side shielding element overlaps the toothing of the contact-side shielding element.

16. The plug insert of claim 15, wherein the toothing of the plug-side shielding element is spaced apart from the toothing of the contact-side shielding element by a spacing.

17. The plug insert of claim 16, wherein the spacing is less than a material thickness of each of the plug-side shielding element and the contact-side shielding element.

18. A plug insert, comprising:

a base body having a plug side and an opposite contact side;

a receptacle extending through the base body from the plug side to the contact side and at least partially receiving a connector; and a positioning element at least partially received in the receptacle, accessible from both the plug side and the contact side, and positioning a contact pin of the connector, the positioning element having at least two connecting webs connecting the positioning element to the receptacle and holding the positioning element symmetrically in the receptacle, an aperture is disposed in a circumferential direction about the positioning element and between the at least two connecting webs and the aperture extends continuously along the positioning element from the plug side to the contact side.

19. A plug insert, comprising:

a base body having a plug side and an opposite contact side;

a receptacle extending through the base body from the plug side to the contact side and at least partially receiving a connector; and a positioning element at least partially received in the receptacle, accessible from both the plug side and the contact side, and positioning a contact pin of the connector, the positioning element having at least two connecting webs connecting the positioning element to the receptacle and holding the positioning element symmetrically in the receptacle, the at least two connecting webs including at least one plug-side connecting web and at least one contact-side connecting web, the at least one plug-side connecting web and the at least one contact-side connecting web offset relative to each other in the circumferential direction.

20. The plug insert of claim 19, wherein the at least one plug-side connecting web and the at least one contact-side connecting web are offset relative to each other in a longitudinal direction of the positioning element extending between the plug side and the contact side.

21. A plug insert, comprising:

a base body having a plug side and an opposite contact side;

a receptacle extending through the base body from the plug side to the contact side and at least partially receiving a connector; and a positioning element at least partially received in the receptacle, accessible from both the plug side and the contact side, and positioning a contact pin of the connector, the positioning element having a connecting web connecting the positioning element to the receptacle and a receiving pocket disposed in the receptacle and receiving a shielding element.

22. The plug insert of claim 21, wherein the receiving pocket overlaps the connecting web in a longitudinal direction of the positioning element.

23. A plug insert, comprising:

a base body having a plug side and an opposite contact side;

a receptacle extending through the base body from the plug side to the contact side and at least partially receiving a connector, the connector including an electromagnetic shielding having at least two shielding elements including a plug-side shielding element inserted from the plug side into the receptacle and a contact-side shielding element inserted from the contact side into the receptacle to form the electromagnetic shielding, an end of the contact-side shielding element overlaps an end of the plug-side shielding element in the receptacle and the plug-side shielding element has a recess at the end, the recess extending in a circumferential direction to form a toothing of the plug-side shielding element; and a positioning element at least partially received in the receptacle and accessible from both the plug side and the contact side, the positioning element positioning a contact pin of the connector, a portion of each of the plug-side shielding element and the contact-side shielding element is disposed between the positioning element and an inner wall of the receptacle.

24. The plug insert of claim 23, wherein the toothing of the plug-side shielding element is complementary to a toothing of the contact-side shielding element disposed at the end of the contact-side shielding element.

25. The plug insert of claim 24, the toothing of the plug-side shielding element overlaps the toothing of the contact-side shielding element.

26. The plug insert of claim 25, wherein the toothing of the plug-side shielding element is spaced apart from the toothing of the contact-side shielding element by a spacing.

27. The plug insert of claim 26, wherein the spacing is less than a material thickness of each of the plug-side shielding element and the contact-side shielding element.

* * * * *